US005195475A

United States Patent [19]

Murphy et al.

[11] Patent Number: 5,195,475

[45] Date of Patent: Mar. 23, 1993

[54] ROCKER ARM ASSEMBLY

[75] Inventors: Richard F. Murphy; Gordon L. Steltzer, both of Torrington, Conn.

[73] Assignee: The Torrington Company, Torrington, Conn.

[21] Appl. No.: 890,992

[22] Filed: May 29, 1992

[51] Int. Cl.[5] ..... F01L 1/18

[52] U.S. Cl. ..... 123/90.39; 123/90.41; 74/519; 74/559; 384/560; 384/569; 384/906

[58] Field of Search ..... 123/90.39, 90.41, 90.42; 74/519, 559; 384/560, 569, 906

[56] References Cited

U.S. PATENT DOCUMENTS

| | | | |
|---|---|---|---|
| Re. 33,870 | 4/1992 | Fittro et al. | 123/90.41 |
| 1,786,926 | 12/1930 | Wells | 384/560 |
| 3,251,350 | 5/1966 | Thompson | 123/90.41 |
| 3,621,823 | 11/1971 | Lombardi | 123/90.42 |
| 4,674,453 | 6/1987 | Dove | 123/90.39 |
| 4,718,379 | 1/1988 | Clark | 123/90.39 |
| 4,724,802 | 2/1988 | Ishii | 123/90.39 |
| 4,944,257 | 7/1990 | Mills | 123/90.39 |
| 5,063,889 | 11/1991 | Pryba et al. | 123/90.39 |
| 5,074,261 | 12/1991 | Hamburg et al. | 123/90.39 |
| 5,123,384 | 6/1992 | Abbas | 123/90.39 |

*Primary Examiner*—E. Rollins Cross
*Assistant Examiner*—Weilun Lo
*Attorney, Agent, or Firm*—John C. Bigler

[57] ABSTRACT

A bearing support member, mountable about a support stud, has two support arms extending toward side walls of a rocker arm. A bearing cup is rigidly mounted on each respective side wall and extends over the respective arm of the bearing support member, providing an annulus. Rolling members within the annulus permit the rocker arm to freely oscillate rotatably while being constrained axially. The bearing cups may include a keyed shape to limit orientation of the bearing support member. Another aspect of the invention is a rocker arm subassembly having "open" bearing cups.

23 Claims, 2 Drawing Sheets

ROCKER ARM ASSEMBLY

BACKGROUND OF THE INVENTION

This invention relates generally to valve operating mechanisms for use in internal combustion engines and, more particularly, to an oscillating rocker arm assembly and subassembly having rolling members.

Conventional valve train rocker arms of internal combustion engines use various bearing means. In addition to loads generated by the rocker arms pushing the valves against the force of the valve springs, loads are generated by the oscillating motion of the rocker arms themselves. In order to increase fuel efficiency and performance of internal combustion engines, bearings with rolling members have been used in place of plain bearings to accommodate those loads.

Typically, a rocker arm assembly with rolling members is supported on a support shaft mounted perpendicularly on a support stud extending from the head of the engine. The rocker arm is pivoted on the support shaft, which serves as an inner raceway, by means of drawn cup needle roller bearings mounted on the rocker arm. Retaining rings on the ends of the support shaft engage the cups of the bearings to limit axial movement of the support shaft relative to the rocker arm.

Other rocker arm assemblies with rolling members have been proposed which permit a support shaft and bearing subassembly to be loaded into a rocker arm from the top or from the side. However, such subassemblies require an expensive "closed" (2-bend) cup bearing and may be subject to inadvertent upside down assembly. Some such proposals may have axial "slop" of the rocker arm with respect to the support shaft.

Another problem common with previously proposed rocker arm assemblies is inadequate rigidity of the rocker arm. Rocker arms may be cast of alloy to achieve sufficient rigidity without unacceptable weight; however, such construction is expensive and impractical for many applications. Rocker arms may also be made by punching and stamping steel sheet into a cup-shaped configuration, but such rocker arms may not be sufficiently rigid for some purposes.

The foregoing illustrates limitations known to exist in present rocker arm bearing assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a rocker arm assembly having a rocker arm with two spaced apart side walls and an aperture for receiving a stud means. A bearing support member within the rocker arm has two support arms extending in opposite directions, each support arm extending toward one of the side walls of the rocker arm, the bearing support member being adapted for mounting about the stud means. Two bearing cups having a common axis are rigidly mounted on the side walls of the rocker arm, extending over a portion of the respective arm of the bearing support member. At least one bearing cup includes key means for engaging keyway means on the support arm to limit orientation therebetween. Rolling members within an annulus formed between the bearing cups and the bearing support member provide free oscillation of the rocker arm with respect to the bearing support member and retain the rocker arm axially with respect to the bearing support member.

In another aspect of the present invention, this is accomplished by providing a rocker arm assembly having a rocker arm with two spaced apart side walls and an aperture for receiving a stud means. A bearing support member within the rocker arm has two support arms extending in opposite directions, each support arm extending toward one of the side walls of the rocker arm, the bearing support member being adapted for mounting about the stud means. Two "open" bearing cups having a common axis are rigidly mounted on the side walls of the rocker arm, extending over a portion of the respective arm of the bearing support member. Rolling members within an annulus formed between the bearing cups and the bearing support member provide free oscillation of the rocker arm with respect to the bearing support member and retain the rocker arm axially with respect to the bearing support member.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
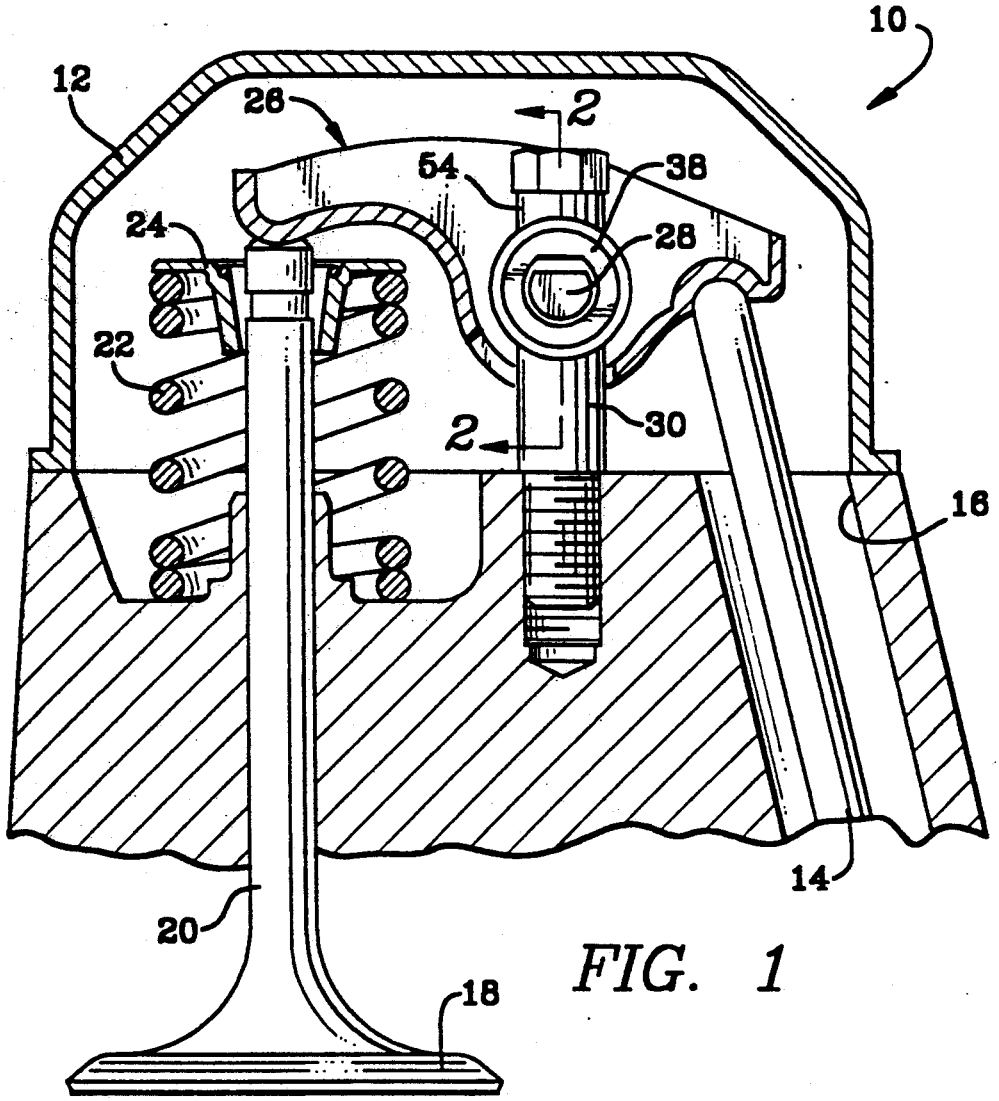
FIG. 1 is a side view, partially in section, showing a portion of an internal combustion engine illustrating an embodiment of the rocker arm assembly of the present invention.

Referring now to the drawings, FIG. 1 illustrates a portion of an internal combustion engine 10 and the relative positions of a valve cover 12, push rod 14, cylinder head 16, poppet valve 18, valve stem 20, valve spring 22, and valve spring retainer 24. Those engine parts are conventional and are illustrated to show the environment of the present invention.

Figure 2:
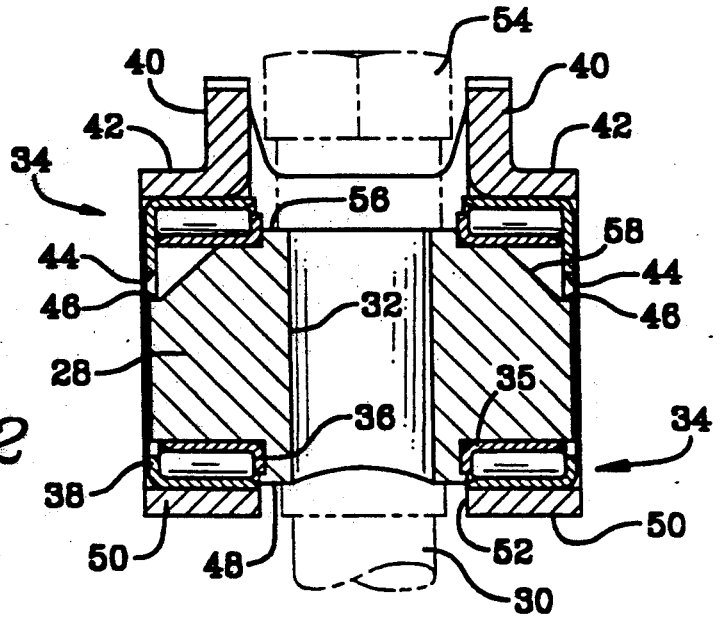
FIG. 2 is an enlarged partial sectional view of the rocker arm assembly, taken along the line 2—2 of FIG. 1.

A rocker arm 26 is supported on a bearing support member 28 to form the rocker arm assembly of the present invention. As illustrated in FIG. 2, the bearing support member 28 has a substantially vertical bore 32 slightly larger than the diameter of a stud means 30 to allow insertion of the stud means 30. Two annular roller bearings 34 are mounted on support arms of the bearing support member 28 that extend in opposite directions.

The roller bearings 34 have cylindrical rollers 35 within an annulus formed between inner sleeves 36 and bearing cups 38. The bearing cups 38 have a common axis and are rigidly mounted on the side walls 40 of the rocker arm 26. Preferably, each of the side walls 40 has an outwardly extending flange 42 forming co-axial cylindrical openings providing an interference fit with the respective bearing cups 38 for additional support and for enhancing the rigidity of the rocker arm 26.

Preferably, the bearing cups 38 are of the "open" type. That is, the bearing cups have a "bottom" surface, cylindrical side surfaces formed by a single bend from the "bottom" surface, and an open "top". For that reason, the bearing cups 38 are substantially simpler and less expensive to manufacture than the "closed" (two bends) type bearing cups used with previous rocker arm assemblies with rolling members.

Figure 3:
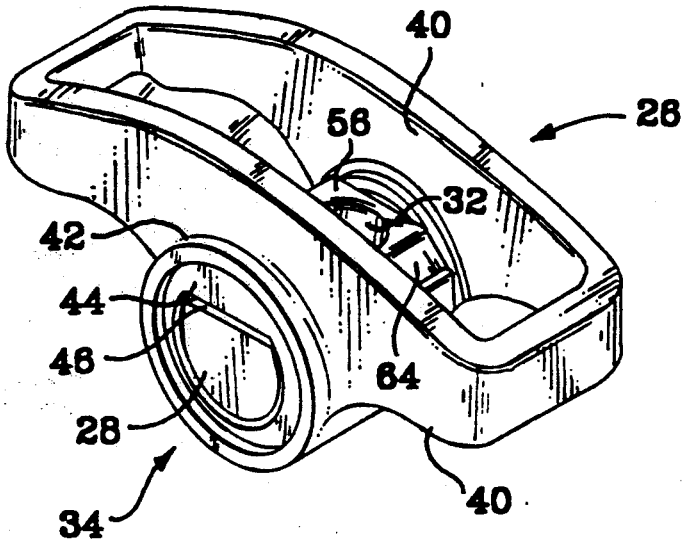
FIG. 3 is a pictorial view of the rocker arm assembly of FIG. 1.

As shown in FIGS. 2 and 3, the "bottom" surface of at least one of the bearing cups 38 may have a D-shaped opening with a flat portion or other key means 44 extending into an otherwise circular opening. A corresponding recess 46 forming a D-shape or other configuration on at least one arm of the bearing support member 28 serves as a keyway for receiving the key means 44. The recess 46 is sufficiently large to allow the rocker arm 26 to oscillate rotatably with respect to the bearing support member 28.

The purpose of the key means 44 and the corresponding recess 46 is to ensure that the bearing support member 28 is assembled into the rocker arm 26 with the proper orientation, that is, that the bearing support member 28 is not inadvertently "upside down". During assembly, the bearing support member 28 and the bearings 34 can be conveniently inserted into the rocker arm 26 by a machine that uniformly positions the D-shaped opening or other key means 44 relative to the rocker arm 26 .

As shown in FIG. 2, the cylindrical rollers 35 are constrained in the direction of their axes by the bearing cups 38 and the inner sleeves 36. The "bottom" surface of the bearing cups 38 prevents outward movement of the cylindrical rollers 35 away from the stud means 30, and a radially outwardly extending flange at the inward ends of the inner sleeves 36 prevents inward movement of the cylindrical rollers 35 toward the stud means 30.

Alternatively, the bearing support member 28 can serve as an inner raceway for the cylindrical rollers 35 and can have an outwardly extending shoulder 48 for preventing inward movement of the cylindrical rollers 35 toward the stud means 30. In either case, the rocker arm 26 is positively located along the axis of the bearing support member 28 such that no axial "slop" is permitted. In the preferred embodiment shown, axial force on the rocker arm 26 is resisted by the cylindrical rollers 35. As an alternative, axial movement of the rocker arm 26 relative to the bearing support member 28 can be prevented by engagement of the bearing cups 38 by the inner sleeves 36, or by other means.

As shown in FIG. 3, the rocker arm 26 has a generally cup-shaped configuration and can be economically manufactured using punching and pressing operations. The two side walls 40 extend upwardly from a lower portion 50. The lower portion 50 is formed with an elongated aperture 52 to provide clearance for the stud means 30 as the rocker arm 26 oscillates rotatably about the bearing support member 28.

The stud means 30 may include wrench flats (not shown) for insertion as a stud or, alternatively, may be a cap screw or bolt, as shown in FIG. 1. In either case, a stud nut or bolt head 54 engages a flat surface 56 on the top of the bearing support member 28 to resist forces of the valve spring 22 and the push rod 14 that would tend to push the rocker arm 26 upward away from the cylinder head 16.

Figure 4:
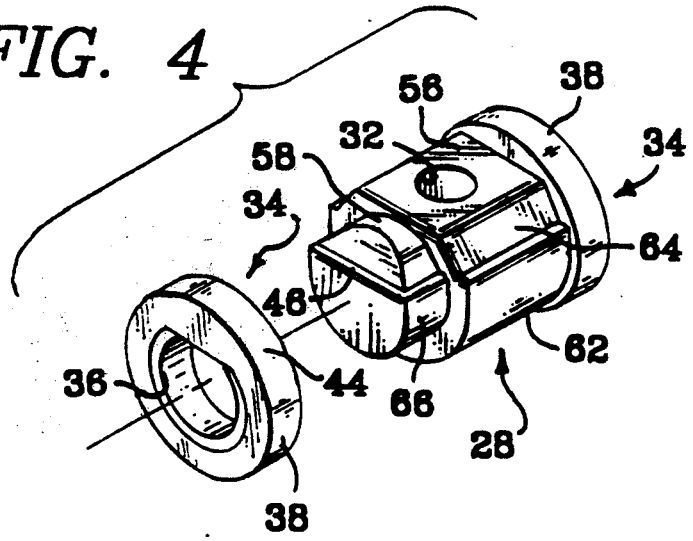
FIG. 4 is an exploded pictorial view of the bearing support member and bearings forming a subassembly of the rocker arm assembly of FIG. 1.

The recess 46 forming the D-shape or other configuration on the bearing support member 28 may include a beveled surface 58, as shown in FIG. 4. Because the cylindrical rollers 35 ride on a raceway provided by the inner sleeves 36, and because the greatest force is on the lower portion of the bearings 34, the beveled surface 58 on the top portion of the bearing support member 28 does not affect the operation of the rocker arm assembly.

The beveled surface 58 facilitates manufacture of the bearing support member 28 by powdered metal forming. FIG. 4 shows a central portion 62 of the bearing support member 28 having additional beveled surfaces 64 for facilitating powdered metal forming. The configuration of such surfaces and their advantages for use with powdered metal forming is disclosed in U.S. Pat. No. 5,074,261, of which Applicants are co-inventors. Alternatively, the arms and the central portion of the bearing support member 28 may be cylindrical rather than beveled.

As shown in FIG. 4, the bearing support member 28 and the bearings 34 form a subassembly having a generally cylindrical configuration. The bearing support member 28 central portion 62 has a smaller cross-section (smaller overall diameter) than the bearing cup 38 to permit the subassembly to be inserted laterally into the openings of the side walls 40 of the rocker ar 26 with the bearing cups 38 being securely press-fit therein. The arms of the bearing support member 28 have generally cylindrical portions 66 over which the inner sleeves are press-fit.

From the above, it will be apparent that the present invention provides a roller bearing rocker arm assembly that has substantially no axial "slop" of the rocker arm with respect to the bearing support member. The rocker arm of the invention is rigid and can be economically manufactured by punching and pressing operations rather than by casting. The invention also provides a rocker arm subassembly that uses relatively inexpensive "open" bearing cups and prevents inadvertent "upside down" assembly.

Having described the invention, what is claimed is:

1. A rocker arm assembly for mounting about a stud means, the assembly comprising:

a rocker arm having two spaced apart side walls and having an aperture for receiving the stud means;

a bearing support member within the rocker arm having two support arms extending in opposite directions, each support arm extending toward one of the side walls of the rocker arm, the bearing support member being adapted for mounting about the stud means;

two bearing cups having a common axis, one bearing cup rigidly mounted on each side wall of the rocker arm and extending over a portion of the respective arm of the bearing support member, at least one bearing cup including key means for engaging keyway means on the support arm to limit orientation therebetween; and rolling members within an annulus formed between the bearing cups and the bearing support member such that the rocker arm is free to oscillate rotatably with respect to the bearing support member, the rocker arm being constrained axially with respect to the bearing support member.

2. The rocker arm assembly of claim 1, wherein each side wall of the rocker arm has an opening for receiving the bearing cup mounted thereon and the rocker arm opening forms an interference fit with the bearing cup to secure the rocker arm assembly.

3. The rocker arm assembly of claim 2, wherein the bearing support member is smaller in cross-section than the openings of the side walls such that the bearing support member can be inserted through one of said openings during assembly.

4. The rocker arm assembly of claim 1, wherein the keyway means comprises a recess formed by a D-shaped surface on at least one of the arms of the bearing support member.

5. The rocker arm assembly of claim 1, wherein the key means comprises a D-shaped opening in at least one of the bearing cups.

6. The rocker arm assembly of claim 1, wherein each of the bearing cups comprises an "open" cup having a "bottom" surface, cylindrical side surfaces, and an open "top".

7. The rocker arm assembly of claim 6, wherein the key means comprises a D-shaped opening in the "bottom" surface of at least one of the bearing cups.

8. The rocker arm assembly of claim 1, wherein each of the side walls of the rocker arm each has an outwardly extending flange forming co-axial cylindrical openings for supporting the respective bearing cup and for enhancing rigidity of the rocker arm.

9. The rocker arm assembly of claim 1, further comprising an inner bearing race mounted on each arm of the bearing support member radially inward of the rolling members, each inner race including a radially outwardly extending flange limiting axial movement of the rolling members toward the stud means.

10. The rocker arm assembly of claim 1, wherein the rocker arm has a generally cup-shaped configuration, the two side walls of the rocker arm extending upwardly from a lower portion of the rocker arm, said aperture being formed within the lower portion and elongated to provide clearance with respect to the stud means during oscillation of the rocker arm.

11. A bearing assembly for mounting within a rocker arm, the assembly comprising:

a bearing support member having two support arms extending in opposite directions, the bearing support member having a bore for receiving a stud means;

two bearing cups, one bearing cup extending over a portion of one of the arms of the bearing support member, at least one bearing cup including key means for engaging keyway means on the support arm to limit orientation therebetween; and rolling members between the bearing cups and the bearing support member such that the bearing cups are free to oscillate rotatably with respect to the bearing support member while being constrained axially with respect to the bearing support member.

12. The bearing assembly of claim 11, wherein the keyway means comprises a recess formed by a D-shaped surface on at least one of the arms of the bearing support member.

13. The bearing assembly of claim 11, wherein the key means comprises a D-shaped opening in at least one of the bearing cups.

14. The bearing assembly of claim 11, wherein each of the bearing cups comprises an open cup having a "bottom" surface, cylindrical side surfaces, and an open "top".

15. The bearing assembly of claim 14, wherein the key means comprises a D-shaped opening in the "bottom" surface of at least one of the bearing cups.

16. The bearing assembly of claim 11, further comprising an inner bearing race mounted on each arm of the bearing support member radially inward of the rolling members, each inner race including a radially outwardly extending flange limiting axial movement of the rolling members toward the stud means.

17. A rocker arm assembly for mounting about a stud means, the assembly comprising:

a rocker arm having two spaced apart side walls and having an aperture for receiving the stud means;

a bearing support member within the rocker arm having two support arms extending in opposite directions, each support arm extending toward one of the side walls of the rocker arm, the bearing support member being adapted for mounting about the stud means;

two "open" bearing cups having a common axis, one bearing cup rigidly mounted on each side wall of the rocker arm and extending over a portion of the respective arm of the bearing support member, the bearings cups having a "bottom" surface, cylindrical side surfaces, and an open "top", at least one bearing cup "bottom" surface including key means for engaging keyway means on the support arm to limit orientation therebetween; and rolling members within an annulus formed between the bearing cups and the bearing support member such that the rocker arm is free to oscillate rotatably with respect to the bearing support member, the rocker arm being constrained axially with respect to the bearing support member.

18. The rocker arm assembly of claim 17, wherein each side wall of the rocker arm has an opening for receiving the bearing cup mounted thereon and the rocker arm opening forms an interference fit with the bearing cup to secure the rocker arm assembly.

19. The rocker arm assembly of claim 17, wherein the bearing support member is smaller in cross-section than the openings of the side walls such that the bearing support member can be inserted through one of said openings during assembly.

20. The rocker arm assembly of claim 17, wherein the keyway means comprises a recess formed by a D-shaped surface on at least one of the arms of the bearing support member.

21. The rocker arm assembly of claim 17, wherein each of the side walls of the rocker arm has an outwardly extending flange forming co-axial cylindrical openings for supporting the respective bearing cup and for enhancing rigidity of the rocker arm.

22. The rocker arm assembly of claim 17, further comprising an inner bearing race mounted on each arm of the bearing support member radially inward of the rolling members, each inner race including a radially outwardly extending flange limiting axial movement of the rolling members toward the stud means.

23. The rocker arm assembly of claim 17, wherein the rocker arm has a generally cup-shaped configuration, the two side walls of the rocker arm extending upwardly from a lower portion of the rocker arm, said aperture being formed within the lower portion and elongated to provide clearance with respect to the stud means during oscillation of the rocker arm.

* * * * *